US007819448B2

(12) United States Patent
Bates

(10) Patent No.: US 7,819,448 B2
(45) Date of Patent: Oct. 26, 2010

(54) PLATE LIFTING CLAMP

(75) Inventor: Richard Paul Bates, Tully, NY (US)

(73) Assignee: Cooper Brands, Inc., Houston, TX (US)

( * ) Notice: Subject to any disclaimer, the term of this patent is extended or adjusted under 35 U.S.C. 154(b) by 408 days.

(21) Appl. No.: 12/041,330

(22) Filed: Mar. 3, 2008

(65) Prior Publication Data

US 2009/0218836 A1 Sep. 3, 2009

(51) Int. Cl.
*B66C 1/48* (2006.01)

(52) U.S. Cl. ..... 294/101; 294/104

(58) Field of Classification Search ..... 294/101, 294/103.1, 104, 110.1, 114, 901
See application file for complete search history.

(56) References Cited

U.S. PATENT DOCUMENTS

| | | | | |
|---|---|---|---|---|
| 2,360,365 | A * | 10/1944 | Renfroe | 294/104 |
| 2,360,366 | A * | 10/1944 | Renfroe | 294/104 |
| 2,370,411 | A | 2/1945 | Monaco | |
| 2,654,630 | A | 10/1953 | Renfroe | |
| 2,852,300 | A | 9/1958 | Gardner | |
| 3,071,406 | A | 1/1963 | Lucker, Jr. | |
| 3,297,354 | A | 1/1967 | Renfroe | |
| 3,675,963 | A * | 7/1972 | Stijger | 294/104 |
| 3,773,377 | A | 11/1973 | Kopp | |
| 3,857,600 | A | 12/1974 | Hasegawa | |
| 3,947,011 | A | 3/1976 | Tsuyama | |
| 4,113,298 | A | 9/1978 | Kopp | |
| 4,162,804 | A | 7/1979 | Davies | |
| 4,183,571 | A | 1/1980 | Renfroe | |
| 4,449,315 | A | 5/1984 | Puretic | |
| 4,492,401 | A | 1/1985 | Renfroe et al. | |
| 4,498,699 | A | 2/1985 | Davies | |
| 4,702,508 | A | 10/1987 | Weiner et al. | |
| 4,736,971 | A | 4/1988 | McManus | |
| 4,834,442 | A | 5/1989 | Choung | |
| 4,842,314 | A | 6/1989 | Bellow | |
| 4,850,630 | A | 7/1989 | Davies | |
| 4,884,836 | A | 12/1989 | Maye et al. | |
| 5,005,890 | A | 4/1991 | Schwenger | |
| 5,255,950 | A | 10/1993 | Davies | |
| 5,433,493 | A | 7/1995 | Dix et al. | |
| 5,566,999 | A | 10/1996 | Goettl | |
| 5,893,595 | A | 4/1999 | Corbett | |

OTHER PUBLICATIONS

"Operator's Manual: Campbell® Model 'GX' Lifting Clamp." English-language text, pp. 1-6. 2003. Cooper Hand Tools, Apex, North Carolina, USA.

* cited by examiner

*Primary Examiner*—Dean J Kramer
(74) *Attorney, Agent, or Firm*—Coats & Bennett

(57) ABSTRACT

A plate lifting clamp may include a body with a slot sized to receive the plate. A contact member may be positioned at a first side of the slot, and a cam may be attached to the body and positioned at the slot across from the contact member. The cam may include a contact section that extends along a first peripheral edge that faces towards the contact member and contacts against the plate when the cam is in a first rotational position. The cam may also include a second peripheral edge that includes teeth that each includes a first face and a second face. A pawl may be pivotally attached to the body to contact the teeth on the cam. The teeth and the pawl may be configured to control rotation of the cam.

12 Claims, 5 Drawing Sheets

PLATE LIFTING CLAMP

BACKGROUND

The present invention is directed generally to plate lifting clamps for lifting a plate and, more particularly, to a plate lifting clamp with a pawl that locks the device to maintain a clamping force on the plate.

A plate lifting clamp includes a gap to receive an edge of a plate. The gap is formed between a fixed edge and a movable edge. This construction provides for a width of the gap to be adjusted to accommodate plates of varying thicknesses, and also to maintain a clamping force on the plate. A securing mechanism is operatively attached to the movable edge to maintain the clamping force on the plate. In use, the plate lifting clamp is attached to an edge of the plate. Once attached, the plate lifting clamp is attached to a lifting device that lifts both the clamp and the plate. The securing mechanism maintains the movable edge against the plate while the plate is being lifted to prevent inadvertent disengagement of the plate.

Various prior designs have included a lever-actuated mechanism to maintain the movable edge against the plate. These designs were constructed and positioned to engage the movable edge and prevent movement away from the fixed edge. However, these designs may become jammed thus preventing the movable edge from being moved away from the fixed edge. This jamming results in the plate lifting clamp remaining attached to the plate. In addition, many prior designs are cumbersome, particularly those designs that include pieces that are detached from the plate lifting clamp. Further, many of prior designs are not intuitive for the users to determine how to use them As such, there remains a need for alternative plate lifting clamp designs.

SUMMARY

In one illustrative embodiment, the plate lifting clamp may include a body with a slot sized to receive the plate. A contact member may be positioned at a first side of the slot, and a cam may be attached to the body and positioned at the slot across from the contact member. The cam may include a contact section that extends along a first peripheral edge that faces towards the contact member and contacts against the plate when the cam is in a first rotational position. The cam may also include a second peripheral edge that includes teeth that each include a first face and a second face. A pawl may be pivotally attached to the body to contact the teeth on the cam. The teeth and the pawl may be configured to allow rotation of the cam in a first direction when the pawl contacts against the second faces of the teeth, and may prevent rotation of the cam in an opposite second direction when the pawl contacts the first face of one of the teeth.

The various aspects of the various embodiments may be used alone or in any combination, as is desired.

DETAILED DESCRIPTION

Figure 1:
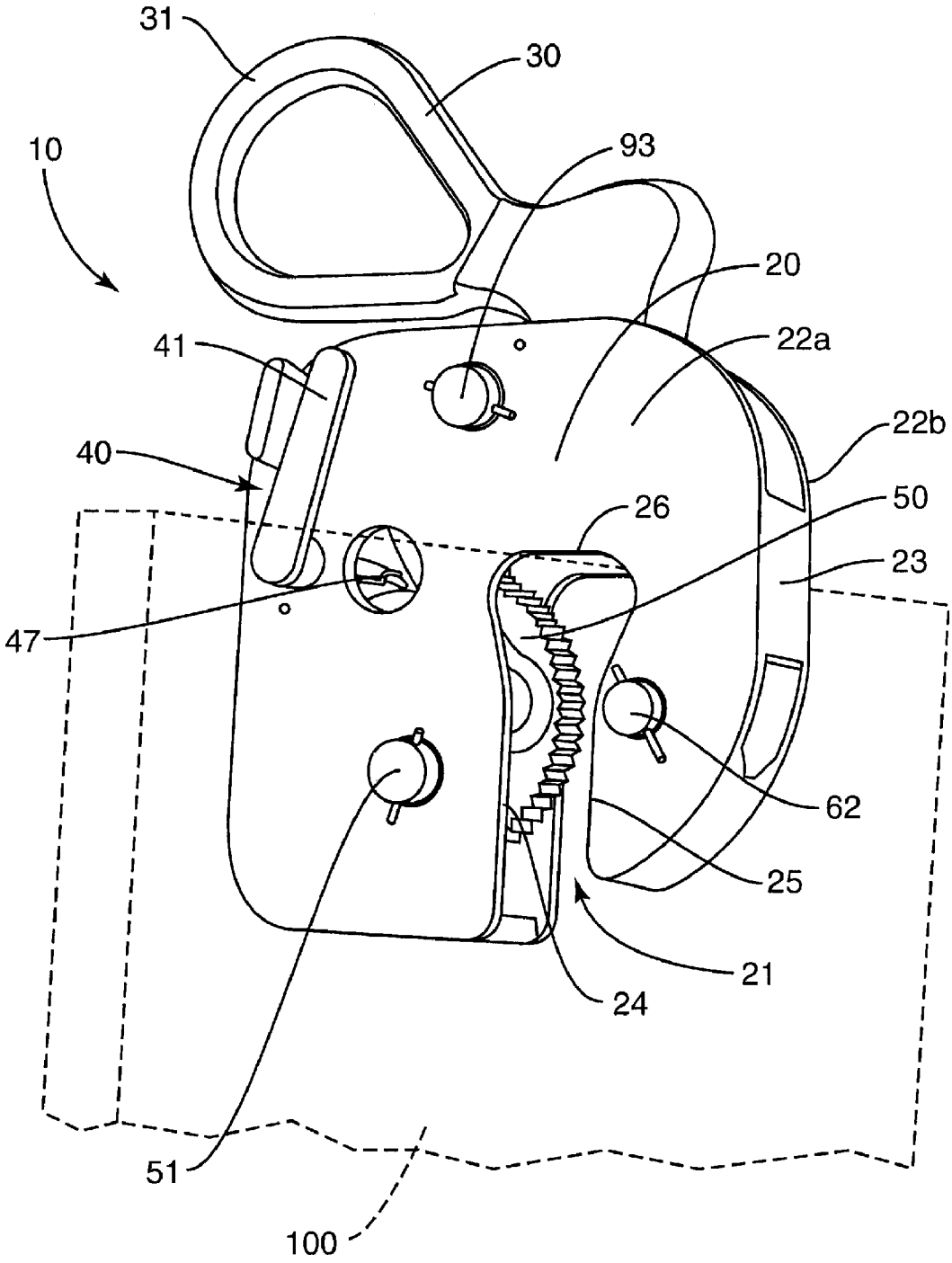
FIG. 1 is a perspective view of a plate lifting clamp according to one embodiment.

The present application is directed to plate lifting clamps for lifting heavy plates of material. The clamps are the type often used in metal plate fabricating and warehousing installations for lifting plates of steel, aluminum, and the like. FIG. 1 illustrates one embodiment of a plate lifting clamp 10 that includes a body 20 with a slot 21 sized to receive a plate 100. A lifting member 30 includes a handle 31 that is lifted by a lifting mechanism, such as a hoist. A cam 50 is positioned within the body 20 and movable into the slot 21 to contact against and maintain the plate within the slot 21. A locking member 40 is operatively attached to the cam 50 and includes a lever 41 on the exterior of the body 20. The cam 50 is prevented from moving away from the plate 100 while the plate 100 is being lifted through the lifting member 30. Further, the cam 50 is prevented from moving away from the plate 100 while the locking member 40 is in a locked position.

The body 20 includes a generally C-shape with the slot 21 extending inward from an edge towards a central area. In one embodiment, body 20 is constructed from first and second members 22*a*, 22*b* that are spaced apart and attached by one or more supports 23. The supports 23 may be positioned around a periphery of the members 22*a*, 22*b*, may be positioned within an interior section, or both. The members 22*a*, 22*b* may be substantially identical, or may include different shapes and/or sizes. The slot 21 is formed by opposing first and second edges 24, 25, and an inner edge 26. In one embodiment as illustrated in FIG. 1, a width of the slot 21 may be greater towards the inner edge 26 than towards a mouth.

Figure 2:
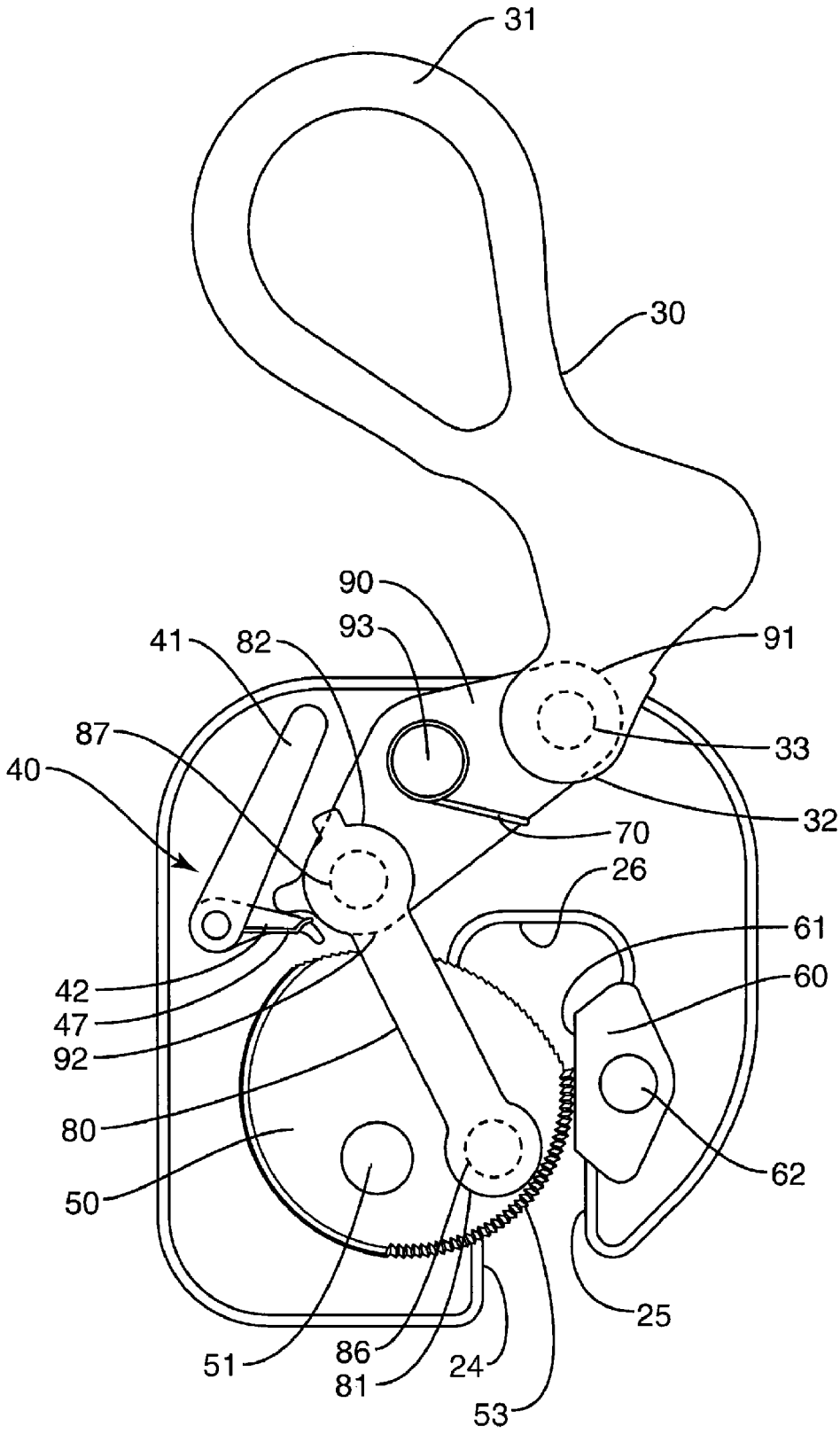
FIG. 2 is a side cut away view of the plate lifting clamp in a closed position according to one embodiment.
Figure 6:
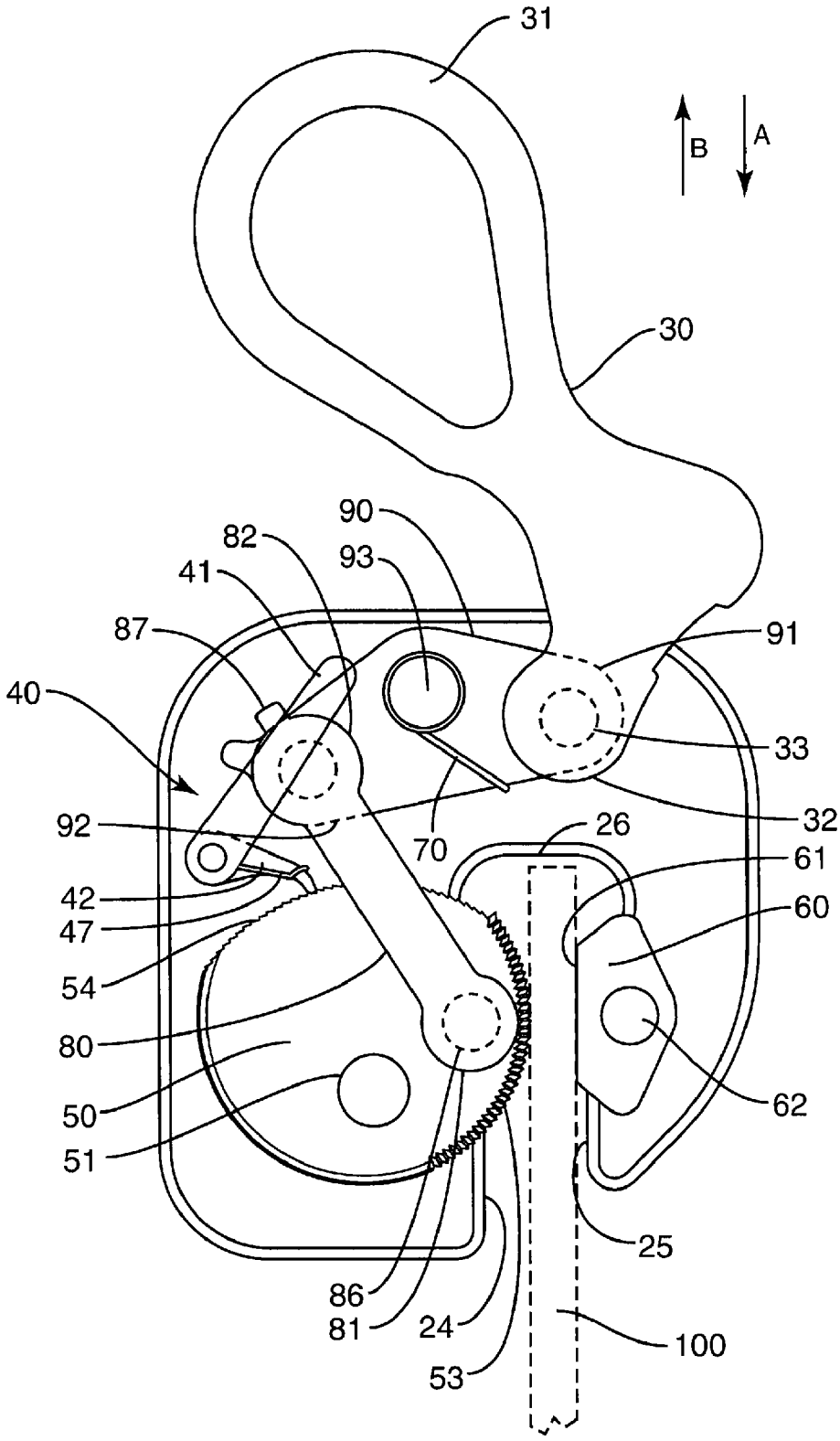
FIG. 6 is a side cut away view of the plate lifting clamp in an open position according to one embodiment.

FIGS. 2 and 6 include the device 10 with the member 22*a* removed to allow a better view of the internal elements. As illustrated in FIG. 2, a pad 60 is positioned at the slot 21. Pad 60 includes an edge 61 that extends outward beyond the second edge 25 to contact the plate 100. Pad 60 is pivotally attached to the body 20 with a pin 62 that extends through the members 22*a*, 22*b*. This attachment provides for the pad 60 to pivot and for the edge 61 to maintain contact against the plate 100.

The cam 50 works in combination with the pad 60 to contact against the plate 100. The cam 50 is rotatable within the body 20 to adjust a width of a gap formed between the pad 60 and the cam 50. Cam 50 is mounted to the body with a pin 51 that also extends through each member 22*a*, 22*b*. This attachment provides for the cam 50 to be rotatable to adjust a width of the gap and to contact against the plate 100 as will be explained below.

Figure 3:
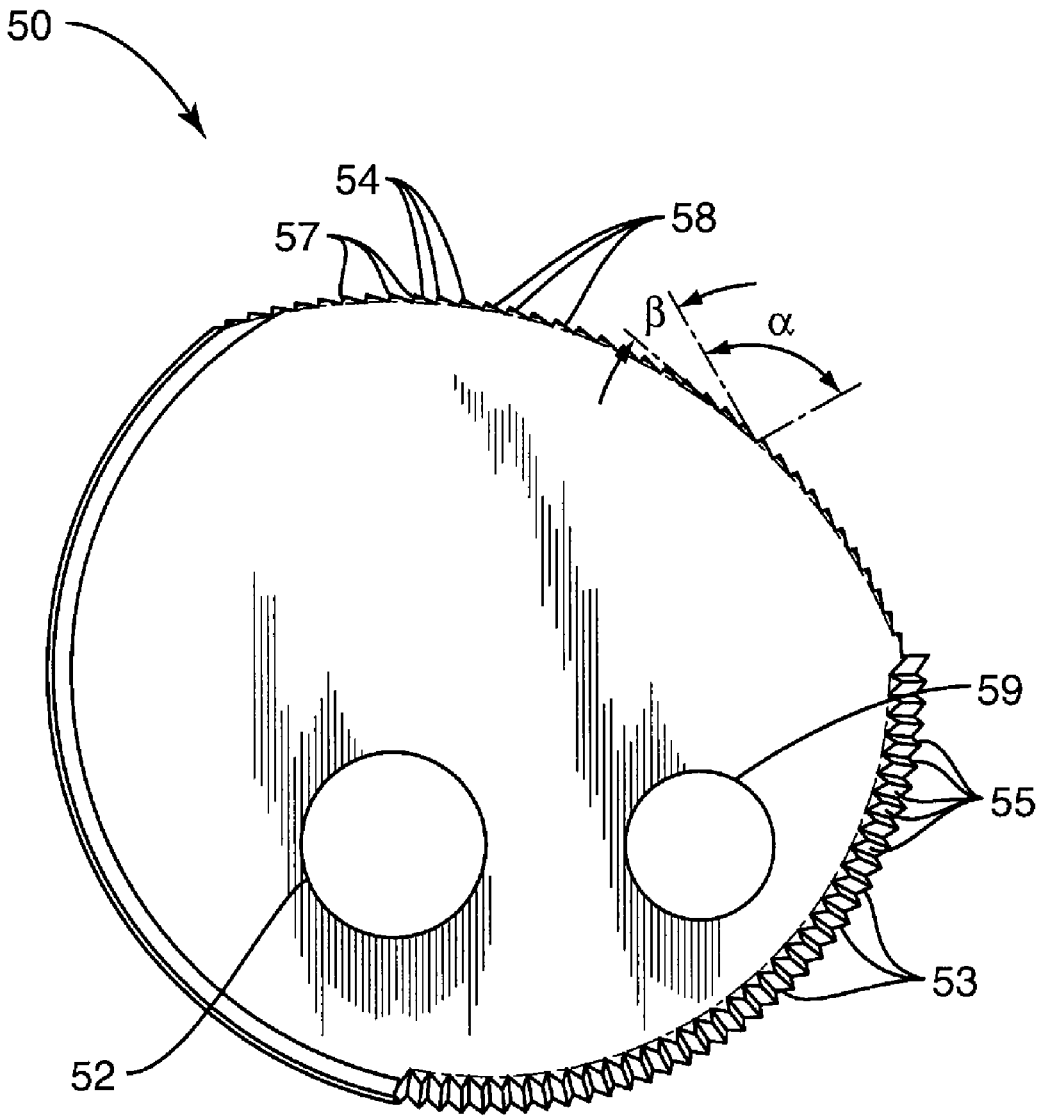
FIG. 3 is a side view of a cam according to one embodiment.

FIG. 3 illustrates one embodiment of the cam 50 that includes an aperture 52 to receive the pin 51. Cam 50 includes an eccentric shape with teeth 53, 54 positioned along sections of the peripheral edge. Teeth 53 contact against the plate 100 to facilitate grasping and prevent possible slipping of the plate 100 from the device 10. Teeth 53 may include a variety of shapes and sizes, and each of the teeth 53 may include the same or different shapes and/or sizes. In one embodiment as illustrated in FIG. 3, each tooth 53 includes faces 55 that are the same shape and size. In one embodiment, the peripheral edge of the cam 50 that contacts the plate 100 is substantially smooth. The teeth 53 may each be positioned at a predetermined gripping angle based on the eccentric shape of the cam 50. As the cam 50 pivots about pin 51, the teeth 53 are arranged relative to the pin 51 such that successive teeth 53 make a preferred gripping angle to maintain engagement with the plate 100 over a range of plate widths.

Teeth 54 are positioned along a second peripheral edge of the cam 50. In one embodiment, the teeth 54 are contiguous along the edge with teeth 53. In another embodiment, the teeth 54 are spaced apart along the edge from teeth 53. Teeth 54 are shaped and configured to interact with a pawl 42 to allow rotation of the cam 50 in a first direction and prevent rotation in a second direction as will be explained below. Each tooth 54 includes a first face 57 and second face 58. In one embodiment as illustrated in FIG. 3, each first face 57 is positioned at an angle $\alpha$ of about 90° with the adjacent second face 58, and each second face 58 is positioned at an angle $\beta$ of about 19° with a line tangent to the surface of the cam 50. Each of the teeth 54 may include faces 57, 58 that are substantially the same, or one or more of the teeth 54 may include different shapes.

A third section of the peripheral edge between the teeth 53, 54 may be substantially smooth. The cam 50 also includes a second aperture 59 to attach with a link 80 as will be explained below. In one embodiment as illustrated in FIG. 3, the aperture 52 to receive the pin 51 is in closer proximity to teeth 53 than to teeth 54.

Figure 4:
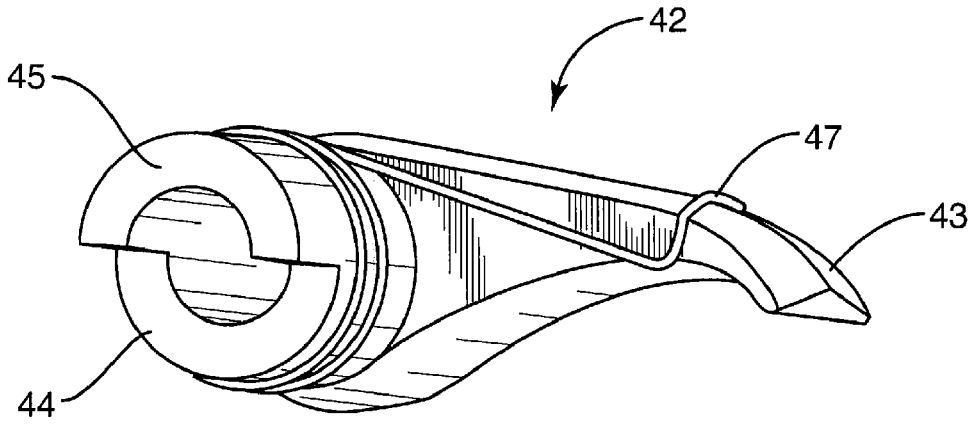
FIG. 4 is a perspective view of a pawl and spring according to one embodiment.
Figure 5:
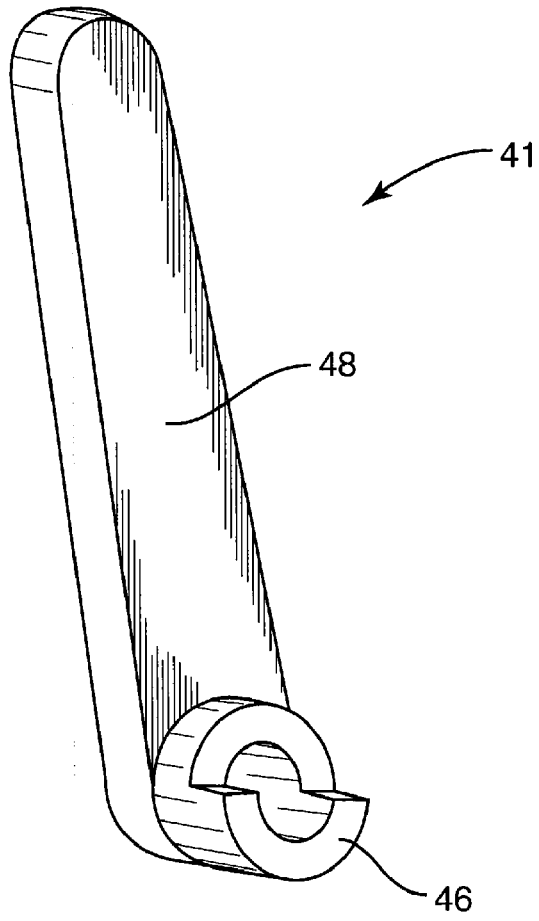
FIG. 5 is a perspective view of a lever according to one embodiment.

A pawl 42 contacts against and prevents inadvertent rotation of the cam 50. Pawl 42 is part of the locking member 40 that also includes the lever 41. The pawl 42 is positioned within the body 20 with the lever 41 positioned on an exterior of the body 20. FIG. 4 illustrates one embodiment of the pawl 42 that includes a first end 43 sized to engage with the teeth 54 on the cam 50. A second end 44 includes a receiver 45 that engages with the lever 41. FIG. 5 illustrates an embodiment of the lever 41 that includes an arm 48 with a neck 46. The neck 46 is sized to fit within an aperture in the first member 22*a* of the body 20 and engage with the receiver 45 of the pawl 42. A fastener (not illustrated) may be inserted through the second member 22*b* and through the receiver 45 and neck 46 to attach together the lever 41 and pawl 42, and to attach the combined locking mechanism 40 to the body 20. In another embodiment, the lever 41 and pawl 42 are constructed from a single unitary piece.

The locking member 40 also includes a spring 47 that forces the pawl 42 towards the cam 50 and into engagement with the teeth 54. In one embodiment, the spring 47 is a torsion spring that includes one more coils that wrap around one or more of the receiver 45, neck 46, and fastener. Spring 47 also extends outward towards the first end 43 to bias the pawl 42 into engagement.

The lifting member 30 is attached to a top of the body 20 substantially opposite from the slot 21. Lifting member 30 includes a handle 31 at a first end for grasping by the lifting mechanism, such as a hoist. A second end 32 is attached to a second link 90 with a connector 33.

The first link 80 and the second link 90 form a connection between the cam 50 and the lifting member 30. First link 80 includes a first end 81 attached to the cam with a connector 86, and a second end 82 attached to a second end 92 of the second link 90 with a connector 87. The second link 90 includes a substantially triangular shape with a first end 91 attached to the lifting member 30 with a connector 33, and the second end 92 attached to the first link 80 with a connector 87. A pin 93 extends through the second link 90 and through the first and second members 22*a*, 22*b* to attach the second link 90 to the body 20. The connectors 33, 86, and 87 and pin 93 allow for the first and second links 80, 90 to be movable within the body 20.

A spring 70 is attached to the second link 90 to bias the first end 91 upward. In one embodiment, the spring 70 is a torsion spring with a coil that wraps around the pin 93 and an arm that contacts the second link 90 at a point between the pin 93 and the first end 91.

In use, the device 10 is placed in an open position with the cam 50 moved away from the pad 60. The cam 50 is moved away an amount such that the gap formed between the cam 50 and pad 60 is adequate to receive the sheet 100. This may include applying a force to the lever 41 to overcome the force of the spring 47 and pivot the pawl 42 away from contact with the teeth 54 of the cam 50. At the same time, a downward force in the direction of arrow A of FIG. 6 is applied to the handle 31 to pivot the second link 90 about the pin 93 in a clockwise direction as the elements are illustrated in FIG. 6. This clockwise movement of the second link 90 lifts the first link 80 thereby causing the cam 50 to rotate in a counterclockwise direction about pin 51. This movement causes the cam 50 to move away from the pad 60 and increase a width of the gap between the cam 50 and pad 60 to receive the plate 100. The necessary amount of movement of the cam 50 away from the pad 60 depends on the thickness of the plate 100. The cam 50 may remain extending outward from the edge 24, or may be moved to be positioned inward from the edge 24.

The device 10 remains in the open position by releasing the lever 41 and allowing the pawl 42 to engage the teeth 54. This engagement is maintained by the force of the spring 47 acting on the first end 43 of the pawl 42 (see FIG. 4). This aspect improves usability as a user moves the cam 50 away from the pad 60 and releases the lever 41 to maintain the device 10 in the open position.

Once the device 10 is in the open position, an edge of the plate 100 is inserted into the gap between the cam 50 and pad 60. Once inserted, the device 10 is moved to a closed position with the cam 50 and pad 60 moving into contact with the plate 10. Movement of the cam 50 towards the closed position (i.e., clockwise rotation about pin 51 as illustrated in FIG. 6) may occur by applying a force on the lever 41 to overcome the force of the spring 47 acting on the pawl 42. This force pivots and lifts the pawl 42 from contact with the teeth 54. This allows the spring 70 acting on the second link 90 to pivot the second link 90 in a counterclockwise direction as illustrated in FIG. 6 thereby causing the second link 90 to drive the first link 80 downward and pivot the cam 50 in a clockwise direction about pin 51.

The device 10 may also be moved to the closed position by applying an upward force to the handle 31 in the direction of arrow B in FIG. 6. This force causes the second link 90 to pivot counterclockwise about the pin 93 and thereby drives the first link 80 downward. This force is greater than the force of the spring 47 acting on the pawl 42 thereby allowing the cam 50 to rotate clockwise to a closed position.

The relatively small angle of the second faces 58 of the cam teeth 54 that contact with the pawl 42 facilitate the rotation of the cam 50 in the first direction and movement towards the closed position.

In the closed position, the plate 100 is maintained between the cam 50 and the pad 60. The orientation of the teeth 53 on the cam 50 provide for contact along a length of the plate 100. Likewise, the pad 60 pivots about pin 62 for the edge 61 to contact along an opposite length of the plate from the cam 50.

Once the device 10 is in the closed position and engages the plate 100, a lifting force is applied to the device 10 to move the plate 100 as necessary. As previously stated, this lifting force may be applied through a lifting mechanism such as a hoist, crane, human, or various other means. This force maintains the first and second links 80, 90 in their respective positions and prevents the cam 50 from rotating in a second, counterclockwise direction and possibly releasing the plate 100.

Further, the pawl 42 remains engaged against the first face 57 of one of the teeth 54 further preventing the cam 50 from moving from the closed position towards the open position.

Once the plate 100 is moved to the appropriate location, the lever 41 may be pivoted to disengage the pawl 42. Further, the lifting member 30 may be forced downward to move the first and second links 80, 90 thereby allowing the cam 50 to rotate towards the open position and release the plate 100.

In one embodiment, the lifting member 30 is attached to one side of the second link 90. In another embodiment, the second end 32 of the lifting member 30 includes a forked orientation and extends on both sides of the second link 90. In one embodiment, the first link 80 includes a single member that extends on one side of the second link 90 and the cam 50. In another embodiment, the first link 80 includes two members with one on each side of the second link 90 and the cam 50.

In one embodiment, the cam 50 is initially forged or flame cut, and then machines to include the teeth 53, 54. In one embodiment as illustrated in FIG. 1, one or both of the springs 47, 70 may be operatively connected to one or both members 22*a*, 22*b* to maintain their position and prevent inadvertent rotation that may affect their ability to bias the pawl 42 and second link 90 respectively.

The present invention may be carried out in other specific ways than those herein set forth without departing from the scope and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A plate lifting clamp to lift a plate, comprising:

a body with a slot sized to receive the plate;

a contact member positioned at a first side of the slot;

a lifting member pivotally attached to the body and including a handle;

a cam rotationally attached to the body and positioned at a second side of the slot across from the contact member, the cam including a contact section that extends along a first peripheral edge that faces towards the contact member to contact the plate, the cam also including a second peripheral edge that includes teeth; wherein the cam further includes an aperture to receive a pin to attach the cam to the body, the aperture positioned in closer proximity to the first peripheral edge than to the second peripheral edge;

a link mechanism operatively attaching the lifting member and the cam, the link mechanism including first and second links, the first link pivotally attached to the lifting member at a first connector and pivotally attached to the second link at a second connector, wherein the first link is pivotally mounted to the body at a fixed pivot point disposed between the first and second connectors;

a pawl pivotally attached to the body to contact the teeth on the cam;

the teeth and the pawl configured to allow rotation of the cam in a first direction when the pawl is in contact with the teeth, and prevent rotation of the cam in an opposite second direction when the pawl is in contact with the teeth.

2. The plate lifting clamp of claim 1, further including a spring operatively attached to the pawl to bias the pawl into contact against the teeth.

3. The plate lifting clamp of claim 1, further comprising a lever attached to the pawl, the pawl positioned within an interior of the body and the lever positioned on an exterior of the body.

4. The plate lifting clamp of claim 1, wherein each of the teeth includes a first face and a second face, the first faces extending outward from the second peripheral edge of the cam at a greater angle than the second faces such that the pawl can slide along the second faces when the cam rotates in the first direction and for one of the first faces to contact against the pawl to prevent rotation in the second direction.

5. The plate lifting clamp of claim 1, further comprising second teeth on the first peripheral edge, the second teeth including different shapes than the teeth on the second peripheral edge.

6. The plate lifting clamp of claim 5, wherein the first peripheral edge is contiguous with the second peripheral edge.

7. A plate lifting clamp to lift a plate, comprising:

a body with a slot sized to receive the plate;

a lifting member pivotally attached to the body;

a contact member positioned at the slot;

a cam positioned at the slot across from the contact member, the cam including a contact section that extends along a first peripheral edge and teeth that extend along a second peripheral edge;

a pin that extends through the cam to attach the cam to the body;

a link mechanism operatively attaching the lifting member and the cam, the link mechanism including first and second links, the first link pivotally attached to the lifting member at a first connector and pivotally attached to the second link at a second connector, wherein the first link is pivotally connected to the body at a fixed pivot point disposed between the first and second connectors;

a pawl pivotally attached to the body to contact the teeth on the cam;

the cam including an eccentric shape and rotatable about the pin between a first rotational position with the contact section of the cam against the contact member and a second rotational positional with the cam away from the contact member and forming a gap to receive the plate; wherein the pin is positioned in closer proximity to the first peripheral edge than to the second peripheral edge;

the teeth and the pawl configured for the pawl to engage the teeth in each of the first and second rotational positions.

8. The plate lifting clamp of claim 7, wherein the contact section faces towards the contact member when the cam is in the second rotational position.

9. The plate lifting clamp of claim 7, wherein second teeth extend along the contact section.

10. The plate lifting clamp of claim 7, further comprising a lever attached to the pawl to move the pawl away from contact with the plurality of teeth, the lever positioned on an exterior of the body.

11. The plate lifting clamp of claim 7, further comprising a spring that biases the pawl into contact with the plurality of teeth.

12. The plate lifting clamp of claim 7, wherein each of the teeth includes a first face and a second face, the first faces extend outward from the second peripheral edge of the cam at a greater angle than the second faces such that the pawl can slide along the second faces as the cam rotates towards the first rotational position and for one of the first faces to contact against the pawl to prevent the cam from rotating towards the second rotational position.

* * * * *